US009412336B2

(12) United States Patent
Bastani et al.

(10) Patent No.: US 9,412,336 B2
(45) Date of Patent: Aug. 9, 2016

(54) DYNAMIC BACKLIGHT CONTROL FOR SPATIALLY INDEPENDENT DISPLAY REGIONS

(71) Applicant: Google Inc., Mountain View, CA (US)

(72) Inventors: Behnam Bastani, San Jose, CA (US); Mary Lou Jepsen, Sausalito, CA (US)

(73) Assignee: Google Inc., Mountain View, CA (US)

( * ) Notice: Subject to any disclaimer, the term of this patent is extended or adjusted under 35 U.S.C. 154(b) by 131 days.

(21) Appl. No.: 14/047,775

(22) Filed: Oct. 7, 2013

(65) Prior Publication Data

US 2015/0097853 A1 Apr. 9, 2015

(51) Int. Cl.
*G09G 5/30* (2006.01)
*G09G 5/10* (2006.01)

(52) U.S. Cl.
CPC ..... *G09G 5/10* (2013.01); *G09G 2320/062* (2013.01); *G09G 2320/0626* (2013.01); *G09G 2320/0646* (2013.01); *G09G 2360/122* (2013.01); *G09G 2360/16* (2013.01)

(58) Field of Classification Search
CPC ... G09G 5/02; G09G 5/06; G09G 2320/0666; G09G 2320/0626; G09G 5/14; G09G 2340/125; G09G 5/395; G09G 2340/10; G06T 11/001; G06F 3/14
See application file for complete search history.

(56) References Cited

U.S. PATENT DOCUMENTS 6,480,175 B1 * 11/2002 Schneider ..... 345/32
6,624,870 B1 9/2003 Greene et al.
6,816,141 B1 * 11/2004 Fergason ..... 345/88
7,145,611 B2 12/2006 Dubin et al.
7,339,625 B2 3/2008 Matthys et al.
7,417,617 B2 8/2008 Eichenlaub
7,744,289 B2 6/2010 Hu
7,813,042 B2 10/2010 Mather et al.
(Continued)

FOREIGN PATENT DOCUMENTS

TW 201040930 A 11/2010

OTHER PUBLICATIONS

"Christie MicroTiles Display Wall System," Christie Digital Systems USA, Inc., http://www.christiedigital.com/en-us/video-walls/video-wall-solutions/video-wall-displays/led-based-cubes/microtiles/pages/default.aspx, (Oct. 8, 2013), pp. 1-11.
(Continued)

*Primary Examiner* — Todd Buttram
(74) *Attorney, Agent, or Firm* — Blakely Sokoloff Taylor & Zafman LLP

(57) ABSTRACT

Embodiments of the disclosure describe a tileable display panel including a screen layer to display a unified image, an illumination layer including a two-dimensional array of lamps, and a display layer disposed between the screen layer and illumination layer. The display layer includes a plurality of pixelets each positioned to be illuminated by a corresponding lamp from the illumination layer to project a magnified image sub-portion corresponding to a received subset. The magnified image sub-portions collectively blend together to form the unified image displayed on the screen layer. Embodiments of the disclosure further include illumination layer control logic to determine a brightness value of each of the received subsets of pixel data, and adjust an illumination setting to reduce or increase an illumination output of a lamp in the illumination layer based, at least on part, on the brightness values of the corresponding subset of pixel data.

27 Claims, 6 Drawing Sheets

(56) References Cited

U.S. PATENT DOCUMENTS

| | | | | |
|---|---|---|---|---|
| 8,199,100 | B1 | 6/2012 | Barnhoefer | |
| 9,123,266 | B2 | 9/2015 | Bastani et al. | |
| 2002/0080302 | A1* | 6/2002 | Dubin et al. | 349/73 |
| 2002/0118321 | A1 | 8/2002 | Ge | |
| 2003/0053017 | A1* | 3/2003 | Shi et al. | 349/123 |
| 2003/0117545 | A1 | 6/2003 | Coker et al. | |
| 2004/0164948 | A1* | 8/2004 | Kabel et al. | 345/102 |
| 2006/0038758 | A1* | 2/2006 | Routley et al. | 345/81 |
| 2006/0103815 | A1* | 5/2006 | Peterson | 353/88 |
| 2006/0221020 | A1* | 10/2006 | Winer et al. | 345/84 |
| 2007/0035489 | A1* | 2/2007 | Lee | 345/77 |
| 2007/0103652 | A1 | 5/2007 | Nijim et al. | |
| 2008/0043034 | A1* | 2/2008 | Whitehead | H04N 9/3138 345/617 |
| 2008/0107335 | A1* | 5/2008 | Chao et al. | 382/173 |
| 2008/0259223 | A1 | 10/2008 | Read et al. | |
| 2009/0273540 | A1 | 11/2009 | Schultz | |
| 2010/0177261 | A1 | 7/2010 | Jin et al. | |
| 2012/0127140 | A1* | 5/2012 | Ryan et al. | 345/207 |
| 2013/0050420 | A1* | 2/2013 | Chen et al. | 348/43 |
| 2013/0076763 | A1* | 3/2013 | Messmer | 345/506 |
| 2013/0093646 | A1 | 4/2013 | Curtis et al. | |
| 2013/0187946 | A1* | 7/2013 | Pan et al. | 345/629 |
| 2013/0235072 | A1* | 9/2013 | Longhurst et al. | 345/605 |
| 2013/0314454 | A1* | 11/2013 | Jin et al. | 345/690 |
| 2013/0321477 | A1* | 12/2013 | Gandhi et al. | 345/690 |
| 2014/0078193 | A1* | 3/2014 | Barnhoefer et al. | 345/690 |
| 2015/0022727 | A1 | 1/2015 | Jepsen | |
| 2015/0022754 | A1 | 1/2015 | Jepsen et al. | |
| 2015/0023051 | A1 | 1/2015 | Jepsen et al. | |
| 2015/0097837 | A1 | 4/2015 | Jepsen et al. | |
| 2015/0153023 | A1 | 6/2015 | Jepsen et al. | |

OTHER PUBLICATIONS

PCT/US2014/056810, PCT International Search Report and Written Opinion, mailed Dec. 17, 2014 (8 pages).

PCT/US2014/056810, PCT International Preliminary Report on Patentability, mailed Apr. 21, 2016 (7 pages).

TW 103134791—First Office Action with English translation, mailed Mar. 18, 2016, 16 pages.

* cited by examiner

DYNAMIC BACKLIGHT CONTROL FOR SPATIALLY INDEPENDENT DISPLAY REGIONS

TECHNICAL FIELD

Embodiments of the disclosure relate to the field of computing devices, and more particularly, to display devices.

BACKGROUND

Liquid crystal display (LCD) devices utilize one or more light sources positioned behind or to the side of an LCD panel to produce images on the LCD panel. The use of one or a small number of light sources reduces the effective contrast of the images displayed by the LCD panel. Furthermore, the light generated by multiple light sources is fairly mixed within the backlight region of the LCD device, and thus adjusting brightness for one light source (to reduce power consumption or improve contrast) on one region of the display inadvertently adjusts the brightness of other regions of the display.

BRIEF DESCRIPTION OF THE DRAWINGS

The present disclosure will be understood more fully from the detailed description given below and from the accompanying drawings of various embodiments of the disclosure, which, however, should not be taken to limit the invention to the specific embodiments, but are for explanation and understanding only.

DETAILED DESCRIPTION

Embodiments of an apparatus, system and method for dynamically controlling the backlight of a tileable display panel are described herein. In the following description numerous specific details are set forth to provide a thorough understanding of the embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

Figure 1:
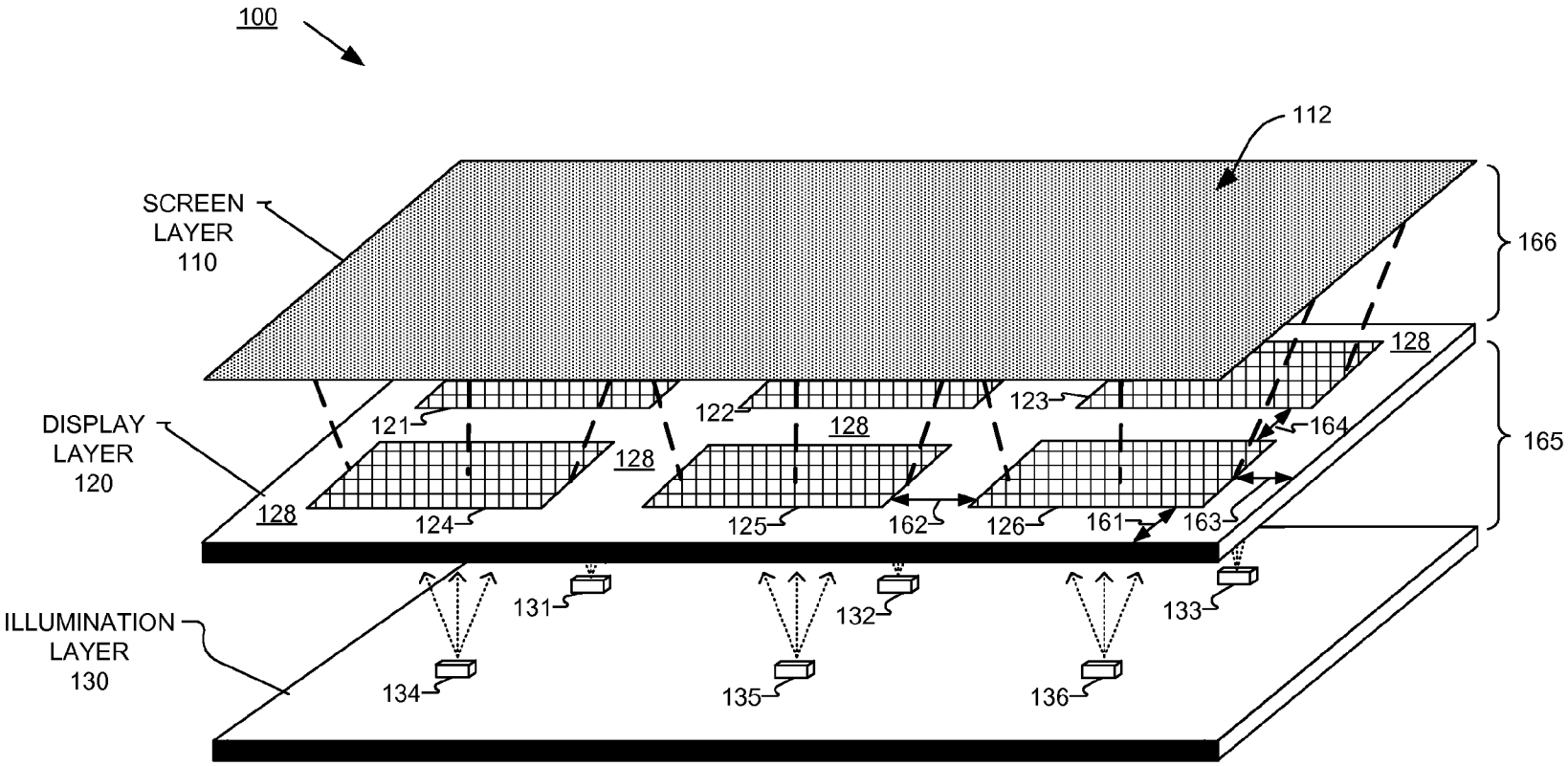
FIG. 1 is an illustration of a tileable display panel according to an embodiment of the disclosure.

FIG. 1 is an illustration of a tileable display panel according to an embodiment of the disclosure. In this embodiment, tileable display panel 100 includes display layer 120 disposed between screen layer 110 and illumination layer 130, which includes lamps 131, 132, 133, 134, 135, and 136 configured in a two-dimensional (2D) array. FIG. 1 shows that each lamp in illumination layer 130 illuminates a corresponding array of transmissive display pixels (referred to herein as a "pixelet" and described further below) to project a plurality of image sub-portions onto the backside of screen layer 110 so that the screen layer displays a unified image.

In one embodiment, each of lamps 131-136 of illumination layer 130 is a laser. In one embodiment, each lamp is a light-emitting-diode ("LED") that emits light from a relatively small emission aperture. For example, LEDs with an emission aperture of 150-300 microns may be used. The LED may emit display light (e.g., white display light, blue display light, or any laser light). Each of lamps 131-136 is configured to emit its display light at a limited angular spread so the display light is directed toward a specific pixelet in display layer 120 (described further below). In one embodiment, additional optics are disposed over the lamp in the array of lamps to define the limited angular spread of the display light emitted from the lamps. The additional optics may also increase brightness uniformity of the display light propagating toward the pixelets.

Display layer 120 is illustrated to include pixelets 121, 122, 123, 124, 125, and 126 configured as a matrix (i.e., a 2D array). Each of said pixelets is an independent array of transmissive display pixels. In some embodiments, each pixelet is a "square" array, such as an array of 100×100 display pixels; of course, in other embodiments, the configuration and quantity of pixels in each pixelet may vary. The pixelets may be liquid-crystal-displays ("LCDs")—e.g., color LCDs or monochromatic LCDs. Where the pixelets are LCDs, a micro-lens in the pixel may not be needed. In one embodiment, each pixelet measures 20×20 mm.

Pixelets 121-126 are shown to be configured in a 2×3 matrix in this embodiment. The pitch between each pixelet in the matrix may be the same. In other words, the distance between a center of one pixelet and the center of its adjacent pixelets may be the same distance. In the illustrated embodiment, each lamp in illumination layer 130 has a one-to-one correspondence with a pixelet, so that each pixelet has a separate corresponding lamp. For example, lamp 131 corresponds to pixelet 121, lamp 132 corresponds to pixelet 122, lamp 133 corresponds to pixelet 123, and so on. Also in the illustrated embodiment, each lamp is centered under its respective corresponding pixelet. Other embodiments may have a different lamp-to-pixelet correspondence, or different lamp positioning.

Display layer 120 also includes spacing regions 128 surrounding pixelets 121-126. Thus, pixelets 121-126 are shown to be separated from each other by at least spacing regions 128. In some embodiments, spacing regions 128 may be significantly larger than an individual display pixel within a given pixelet; on some of these embodiments, spacing regions 128 are large enough to accommodate circuitry such as memory, microprocessors, image sensors, audio output circuitry, etc. Pixelet 126 is illustrated to be adjacent to pixelet 123 and 125. Pixelet 126 is spaced by dimension 162 from pixelet 125 and spaced by dimension 164 from pixelet 123. Dimensions 162 and 164 may be considered "internal spacing" and may comprise the same distance in some embodiments. Pixelet 126 is also spaced by dimensions 161 and 163 from edges of display layer 120. Dimensions 161 and 163 may be considered "external spacing" and are the same distance, in some embodiments. In one embodiment, dimensions 161 and 163 are half of the distance as dimensions 162 and 164. In one example, dimensions 161 and 163 are both 2 mm and dimensions 162 and 164 are both 4 mm.

Spacing region 128 contains a backplane region that may include pixel logic for driving the pixels in the pixelets. The architecture of tileable display panel 100 may increase space for additional circuitry in the backplane region. In one embodiment, the backplane region is used for memory-in-pixel logic. This memory may be used to allow each pixel to be refreshed individually instead of refreshing each pixel in a row at every refresh interval (e.g. 60 frames per second). In one embodiment, the backplane region is used for additional image processing.

While tileable display panel 100 may be used in high-resolution large format displays, the additional image processing capacity may also be useful for image signal processing, for example dividing an image into image sub-portions that are displayed by the pixelets. In another embodiment, the backplane region is used to embed image sensors. In one embodiment, the backplane region includes infrared image sensors for sensing three-dimensional 3D scene data in the display apparatus' environment.

In operation, display light from a lamp (e.g. lamp 131) propagates toward its corresponding pixelet (e.g. pixelet 121). Each pixelet drives their pixels to display an image sub-portion (i.e., a portion of a unified image to be displayed by tileable display panel 100) on the pixelet so the display light that propagates through the pixelet includes the image sub-portion displayed by the pixelet. Since the lamp generates the display light from a small aperture and the display light has an angular spread, the image sub-portion in the display light gets larger as it gets further away from the pixelet. Therefore, when the display light (including the image sub-portion) encounters screen layer 110, a magnified version of the image sub-portion is projected onto a backside of screen layer 110.

Screen layer 110 is offset from pixelets 121-126 by distance 166 to allow the image sub-portions to become larger as the display light propagates further from the pixelet that drove the image sub-portion. Therefore, distance 166 may be a fixed distance selected to configure the size of the magnification of the image sub-portions. In one embodiment, fixed distance 166 is 2 mm. In one embodiment, each image sub-portion generated by pixelets 121-126 is magnified by 1.5×.

The backside of screen layer 110 is opposite viewing side 112. Screen layer 110 may be made of a diffusion screen that presents the unified image on viewing side 112 of screen layer 110 by scattering the display light (that includes the image sub-portions) from each of the pixelets 121-126. Screen layer 110 may be similar to those used in rear-projection systems. Screen layer 110 may have local dimming capabilities independent of lamps 131-136 (e.g., the screen layer may be dimmed based on detected ambient light).

Figure 2:
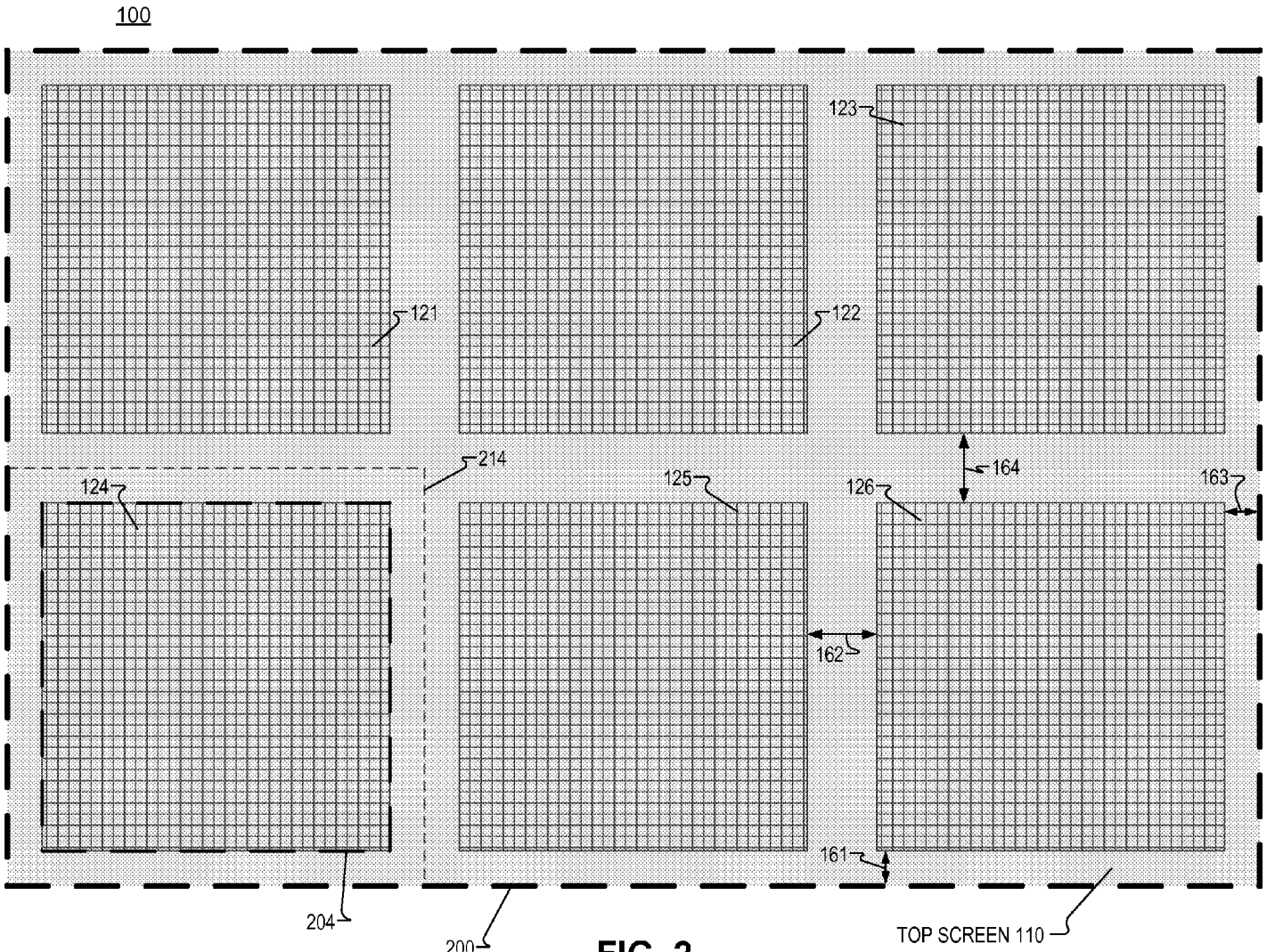
FIG. 2 is a transparent illustration of a tileable display panel according to an embodiment of the disclosure.

FIG. 2 is a transparent illustration of a tileable display panel according to an embodiment of the disclosure. FIG. 2 illustrates tileable display panel 100 looking through screen layer 110 to display layer 120. FIG. 2 shows how tileable display panel 100 can generate a unified image 200 using the magnified image sub-portions (e.g. image sub-portion 214) generated by lamps 131-136 and their corresponding pixelets 121-126. In this illustration, pixelet 124 generates image sub-portion 204 that is projected (using the display light from lamp 134) on screen layer 110 as magnified image sub-portion 214. Although not illustrated, each of pixelets 121, 122, 123, 125, and 126 can also project a magnified image sub-portion onto screen layer 110 that is the same size as magnified image sub-portion 214. Those five magnified image sub-portions combined with magnified image sub-portion 214 combine to form unified image 200. In some embodiments, the geometric alignment of the magnified image sub-portions may leave virtually no gap (if any) such that unified image 200 is perceived as seamless by a viewer.

In FIG. 2, the magnified image sub-portions are illustrated to be roughly the same size and are similarly square-shaped. In other embodiments, said magnified image sub-portions may comprise any shape, any size, and in any combination. To generate same sized magnified image sub-portions, display layer 120 and pixelets 121-126 may be offset from lamps 131-136 by fixed dimension 165 (as shown in FIG. 1). In one embodiment, dimension 165 is 8 mm.

The device architecture of tileable display panel 100 further allows for controlling the brightness of lamps 131-136 based on the image/video content of the corresponding image sub-portions. Each pair of pixelets 121-126 and lamps 131-136 are independent of each other, and in some embodiments, light from one pair of pixelet and lamp (e.g., pixelet 125 and lamp 125) does not leak into any of its neighboring pairs (e.g., pixelet and lamp pairs 124/134, 126/136 and 122/132). Dynamically varying the brightness level of lamps 131-136 based on the image/video content of the corresponding image sub-portions allows for improved contrast in unified image 200 and a reduced power consumption for tileable display panel 100. Furthermore, embodiments may increase the available bit depth for pixel data, resulting in smoother gradients and improved image quality.

Figure 3:
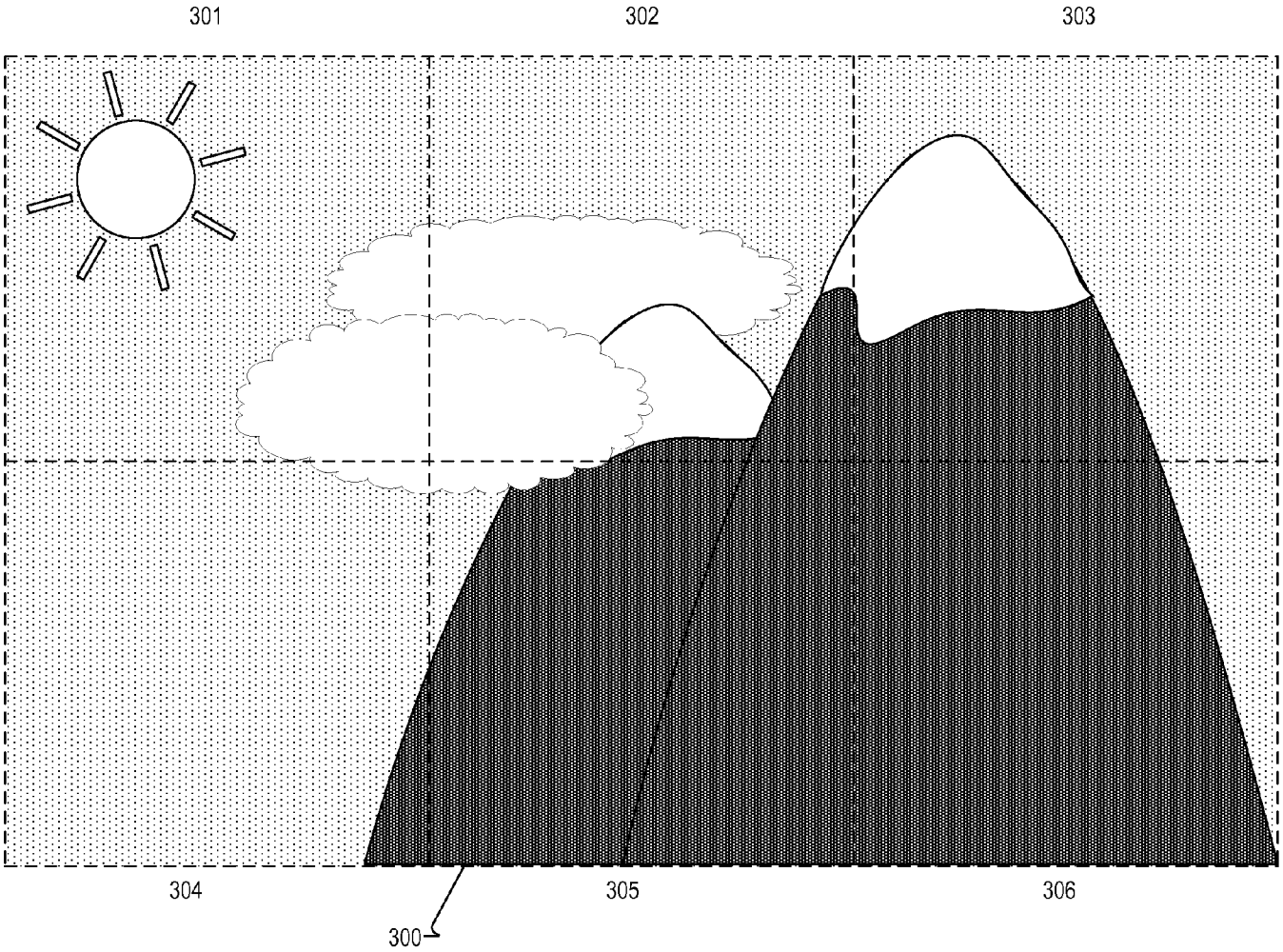
FIG. 3 is an illustration of a unified image displayed by a tileable display panel according to an embodiment of the disclosure.

FIG. 3 is an illustration of a unified image displayed by a tileable display panel according to an embodiment of the disclosure. In this embodiment, unified image 300 is formed from image sub-portions 301, 302, 303, 304, 305 and 306. Each of image sub-portions 301-306 may be collectively blended and generated from a pair of pixelets/lamps as described above with reference to FIG. 1 and FIG. 2. In other embodiments, a larger number of image sub-portions, pixelets and lamps may be utilized.

As shown in FIG. 3, each of image sub-portions 301-306 includes a varying amount of bright (i.e., light) pixel content and dark pixel content. For example, image sub-portion 301 comprises mostly bright pixel content while image sub-portion 306 comprises mostly dark pixel content. Embodiments improve the overall contrast for unified image 300 by reducing the brightness of (at least) the lamps associated with image sub-portions comprising a significant amount of dark pixel content (e.g., image sub-portions 305 and 306).

For example, upon a determination that image sub-portion 306 contains a significant amount of dark pixel content—e.g., determining that an average luminance for the pixels in image sub-portion 306 is less than a threshold value, that a maximum luminance value of the pixels in image sub-portion 306 is less than a threshold value, or that a majority of pixels in image sub-portion 306 have a luminance value less than a threshold value, the lamp corresponding to the pixelet displaying image sub-portion 306 may be dimmed. Conversely, in some embodiments, a lamp may not be set to its maximum brightness setting; for example, a lamp may have been previously dimmed as a result of previously displayed image data, a lamp may be set to a default brightness value less than its maximum, etc. Thus, in response to determining that image sub-portion 301 contains a significant amount of bright pixel content e.g., determining that an average luminance for the pixels in image sub-portion 301 is greater than a threshold value, that a maximum luminance value of the pixels in image sub-portion 301 is greater than a threshold value, or that a majority of pixels in image sub-portion 301 have a luminance value greater than a threshold value, the brightness of the lamp corresponding to the pixelet displaying image sub-portion 301 may be increased.

Thus, embodiments of the disclosure allow for dynamic control of the backlight brightness for a tileable display panel with a higher level of granularity compared to conventional displays. Furthermore, because light from each lamp of a tileable display panel is, in some embodiments, contained within the defined area of the image sub-portion (i.e., rather than having "cross-talk" over multiple image sub-portions), the adjusted brightness of one particular lamp does not "cross-talk" into neighboring image sub-portions.

The above described dynamic backlight control process allows for the display of a larger dynamic range between the lightest and darkest areas of an image compared to the dynamic range of current display devices. By varying the brightness levels for the lamps/pixel areas displaying image sub-portions 301-306 based on the content of their respective image sub-portion, embodiments of the disclosure allow for a more accurate display of the range of intensity levels found in unified image 306.

In some embodiments, the pixel data used to drive the pixelets to display their respective image sub-portion comprises a fixed color depth (e.g., 8-bits, 16 bits). Said fixed color depth (alternatively referred to herein as "bit depth") quantifies how many unique colors are available in an image's color palette; for example, an 8-bit color depth allows for $2^8$ or 256 unique colors to be displayed by a pixel. This does not mean that an image/image sub-portion necessarily includes all of these colors, but that a pixel may instead specify colors with that level of precision.

By varying a brightness level of a pixelet's corresponding lamp, embodiments of the disclosure may increase the color depth of the pixel data. For example, if a lamp has four different illumination levels (excluding a power-off state), pixel data having an 8-bit color depth has an effective bit depth of 10 bits (i.e., two additional bits for the four lamps illumination levels), and thereby increasing the unique colors to be displayed by a pixel to $2^{10}$ or 1024 unique colors.

In some embodiments, these extra bits are used in "tone mapping" or "tonal mapping" processes, which map one set of colors to another (e.g., an 8-bit color representation to a 10-bit color representation) to create a relatively open-ended brightness scale and enable a high dynamic range display of a unified image (e.g., to approximate the appearance of high dynamic range images in a medium that has a more limited dynamic range). In other words, embodiments may use the different illumination settings of lamps to create a greater dynamic range by using the extra bits representing "illumination levels" to specify tonal values proportional to the actual brightness of the content of an image sub-portion.

Figure 4:
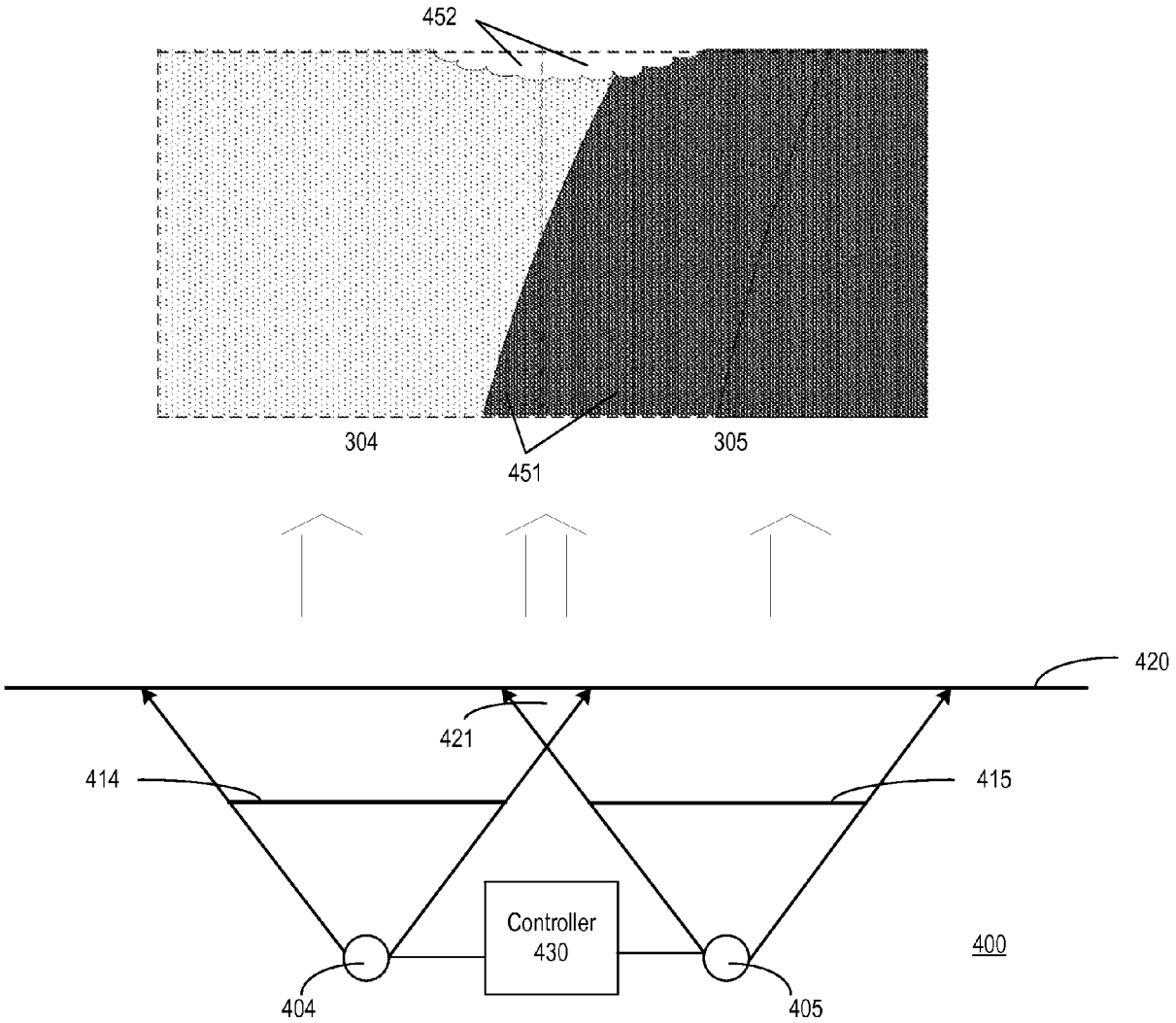
FIG. 4 is an illustration of components of a tileable display panel for displaying image sub-portion data according to an embodiment of the disclosure.

FIG. 4 is an illustration of components of a tileable display panel for displaying image sub-portion data according to an embodiment of the disclosure. In this embodiment, a portions of the components of tileable display panel 400 are illustrated from a bottom-view perspective as including lamp 404 to emit display light at a limited angular spread so the display light is directed toward pixelet 414; as described above, since lamp 404 generates the display light from a small aperture and the display light has an angular spread, the image sub-portion in the display light gets larger as it gets further away from pixelet 414. Therefore, when the display light (including corresponding image sub-portion) encounters screen layer 420, a magnified version of the image sub-portion is projected onto a backside of the screen layer so that it is viewable to the user, shown as image sub-portion 304 from FIG. 3. Lamp 405 and pixelet 415 operate in a similar manner to produce image sub-portion 305 from FIG. 3. In this embodiment, tileable display panel 400 further includes controller 430 to control the illumination settings of the lamps of the display panel (including lamps 404 and 405).

As described above, pixelets 414 and 415 are placed at a fixed distance behind screen layer 420, wherein said fixed distance is selected to configure the size of the magnification of image sub-portions 304 and 305. In this embodiment, to eliminate any possible "seams" of the pixelets of tileable display panel 400, magnified image sub-portions 304 and 305 are shown to overlap at overlap region 421.

As shown in this illustration, image sub-portions 304 and 305 both include high contrasting dark and bright regions that are included in overlap region 421—i.e., dark region 451 and bright region 452. Furthermore, image sub-portion 304 is shown to comprise primarily bright pixel data while image sub-portion 305 is shown to comprise primarily dark pixel data. Controller 430 may include combination of hardware or software illumination control logic/modules to control the illumination settings of the lamps of the display panel as described below.

The overall brightness of the tileable display panel (e.g., tileable display panel 300 of FIG. 3) may be dimmed based on the ambient light surrounding the device. In some embodiments, the brightness level of lamps 404 and 405 may also be adjusted independent of their neighboring pixelet data (e.g., in embodiments where there is no overlap in the plurality of image sub-portions, and thus there is no mixing of the light from the lamps). Thus, lamp 405 may be dimmed in response to determining that the average luminance for the pixels in image sub-portion 305 is less than a threshold value, or in response to determining that the majority of pixels in image sub-portion 305 have a luminance value less than a threshold value. The level to which lamp 405 is dimmed may directly correspond to the pixel data characteristics described above (e.g., based on the average luminance of image sub-portion 305, or based on the ratio of dark-to-light pixel data in image sub-portion 305). Similarly, lamp 406 may have its illumination setting increased in response to determining that the average luminance for the pixels in image sub-portion 304 is greater than a threshold value, or in response to determining that the majority of pixels in image sub-portion 304 have a luminance value greater than a threshold value. The level to which the illumination setting of lamp 404 is increased may directly correspond to the pixel data characteristics described above (e.g., based on the average luminance of image sub-portion 304, or based on the ratio of light-to-dark pixel data in image sub-portion 304).

In this example, because of the high contrast between the pixel data content of image sub-portions 304 and 305, a significant difference between the brightness levels of lamps 404 and 405 may produce an uneven appearance in shared regions 451 and 452, which may be viewed to the user as a "seam" or a noticeable area of non-uniform brightness. In some embodiments, the pixelets are spatially overlapped and optically controlled in a manner such that the risk of a "seam" or a noticeable area of non-uniform brightness is reduced, regardless of the brightness differences of neighboring pixelet/lamp pairs. In some embodiments, the increased bit depth processes described above may allow for an increased amount of adjustable transition brightness values (i.e., increase the granularity for adjusting the brightness values in at least the overlapping area) to mitigate or eliminate these potential contrast issues. In some embodiments, the increased amount of adjustable transition brightness values may be used based on the content of the sub-images. For example, when sub-images include mostly edges (as opposed to smooth regions), embodiments may increase the bit depth to further adjust the brightness of the lamps to produce better reconstructions of the sub-images.

In some embodiments, the brightness level of lamps 404 and 405 are adjusted based, at least in part, on their neighboring pixelet data. Thus, the illumination setting for lamps 404 and 405 may be increased and decreased, respectively, but the change to this setting is limited due to their shared bright and dark regions. Thus, in these embodiments, the displayed unified image exhibits an improved contrast and the risk of a "seam" or a noticeable area of non-uniform brightness is reduced.

Figure 5:
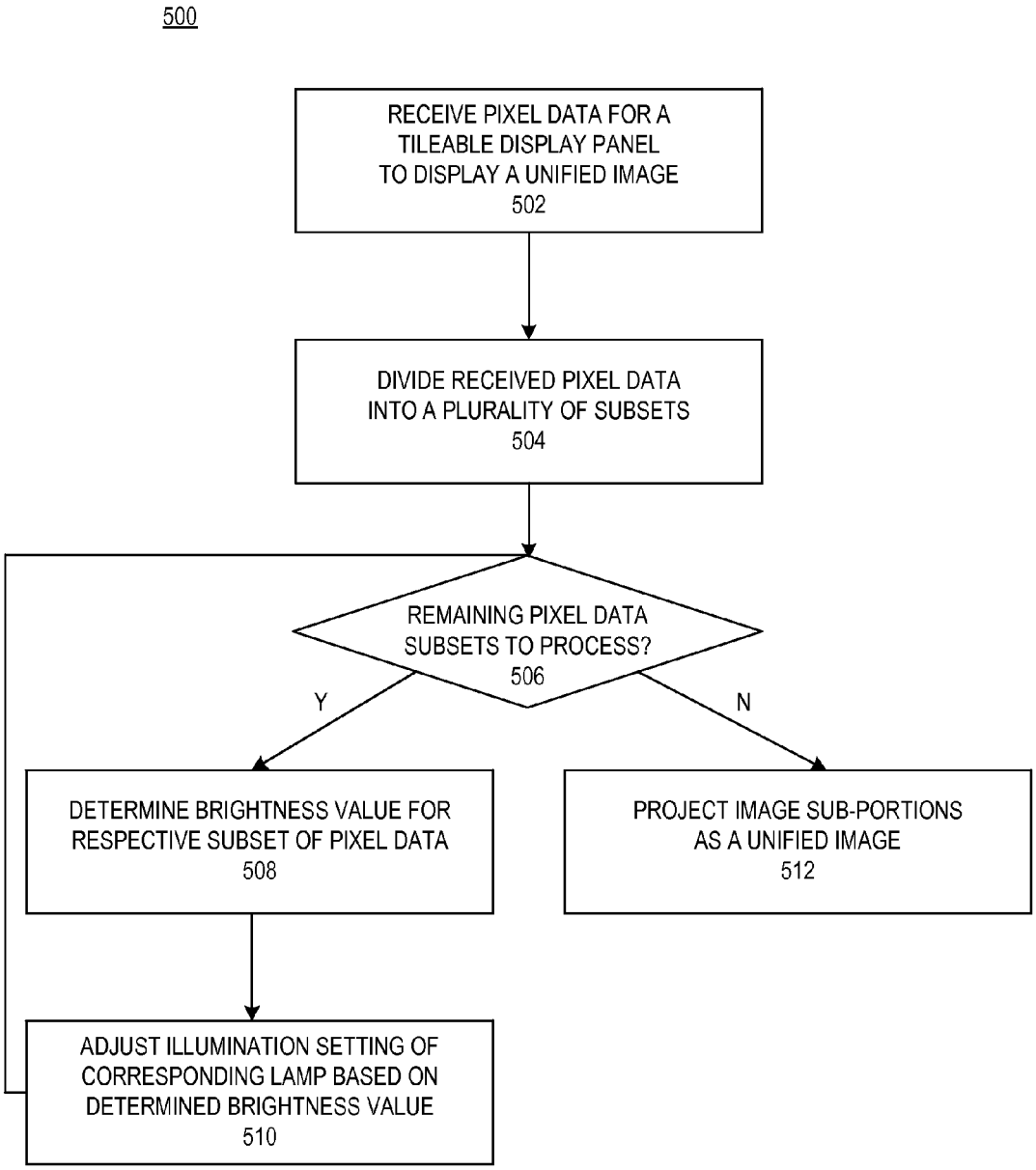
FIG. 5 is a flow diagram of a process for dynamic backlight control according to an embodiment of the disclosure.

FIG. 5 is a flow diagram of a process for dynamic backlight control according to an embodiment of the disclosure. Flow diagrams as illustrated herein provide examples of sequences of various process actions. Although shown in a particular sequence or order, unless otherwise specified, the order of the actions can be modified. Thus, the illustrated implementations should be understood only as examples, and the illustrated processes can be performed in a different order, and some actions may be performed in parallel. Additionally, one or more actions can be omitted in various embodiments of the disclosure; thus, not all actions are required in every implementation. Other process flows are possible.

Process 500 includes operations for receiving pixel data for a tileable display panel to display a unified image, 502. As described above, said tileable display panel may include a screen layer upon which a unified image is projected from a backside, an illumination layer including a 2D array of lamps to generate lamp light, and a display layer disposed between the screen layer and illumination layer. In embodiments of the disclosure, the display layer includes a plurality of pixelets separated from each other by spacing regions, wherein each of the pixelets is positioned to be illuminated by a corresponding lamp from the illumination layer.

The received pixel data is divided into a plurality of subsets, 504. Each subset is to correspond to the number of pixelets in the tileable display panel. In some embodiments, each pixelet is to display a unique image sub-portion; in other embodiments, at least some of the image sub-portions may at least partially overlap.

Each of the subsets of the received pixel data is dynamically processed as described by the operations below, 506. A brightness value of the respective subset of pixel data is determined, 508. This brightness value may comprise, for example, an average luminance of the brightness values of the corresponding subset of the pixel data, or a determined luminance of a majority of pixels of the corresponding subset of the pixel data.

An illumination setting to reduce or increase an illumination output for a lamp in the illumination layer is adjusted, 510, based, at least on part, on the brightness values of the corresponding subset of the pixel data. In some embodiments, this adjustment may be to reduce/increase the illumination output of the lamp in response to the above described determined brightness values of the pixel data being less/greater than a threshold value.

In some embodiments, adjusting the brightness values for each of the received subsets of the pixel data includes converting the pixel data to a higher bit depth representation based, at least on part, on the determined brightness values of the pixel data. This may involve applying a tone mapping function to adjust a dynamic range of the pixel data.

When all the subsets of the received pixel data are processed, the lamps of the illumination layer are illuminated to project a plurality of magnified image sub-portions each corresponding to one of the received subsets of pixel data onto the backside of the screen layer such that the magnified image sub-portions collectively blend together to form the unified image on the display layer of the tileable display panel.

Figure 6:
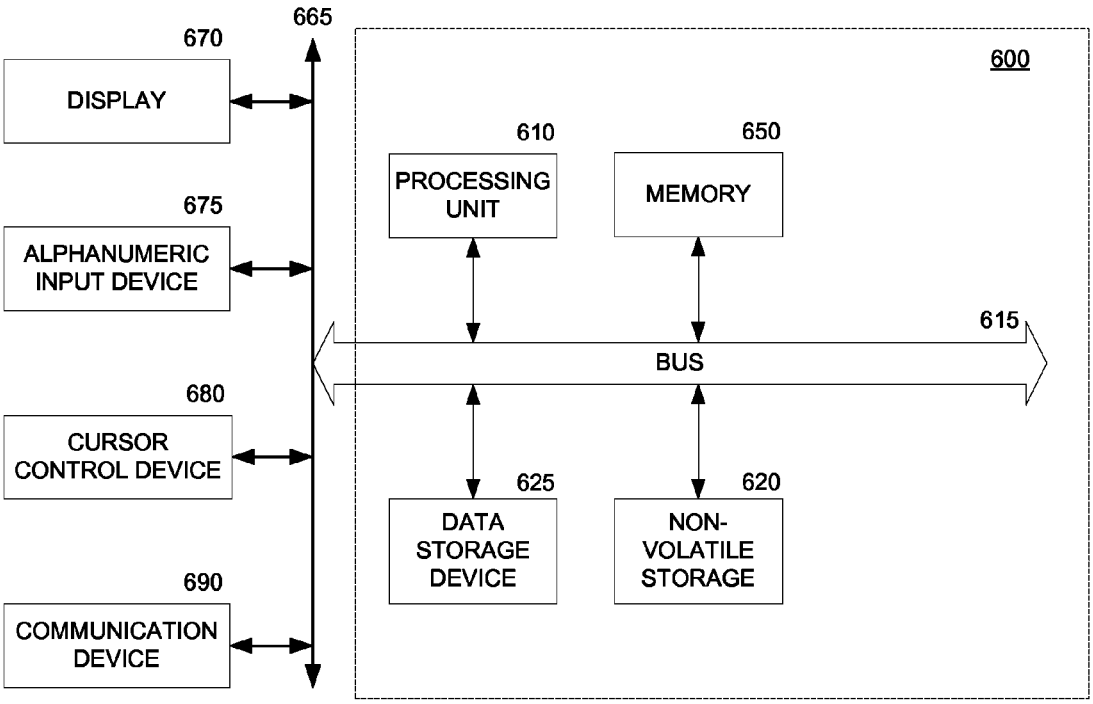
FIG. 6 is an illustration of components of a device to utilize an embodiment of the disclosure.

FIG. 6 is an illustration of components of a device to utilize an embodiment of the disclosure. Platform 600 may be used for the dynamic backlight control processes for tileable display panels described above. Platform 600 may also be used to provide power, display control computing ability (e.g., decoding and converting content) and connectivity (e.g., network connectivity) to device including a tileable display panel. For example, platform 600 may comprise display driver components communicatively coupled to the above described tileable display panel. Platform 600 may be used to decode/convert content into video signal formats such as high definition multimedia interface (HDMI), component, composite digital visual interface (DVI), video graphics adapter (VGA), Syndicat des Constructeurs d'Appareils Radiorecepteurs et Televiseursor (SCART), or other video signal formats.

Platform 600 as illustrated includes bus or other internal communication means 615 for communicating information, and processor 610 coupled to bus 615 for processing information. The platform further comprises random access memory (RAM) or other volatile storage device 650 (alternatively referred to herein as main memory), coupled to bus 615 for storing information and instructions to be executed by processor 610. Main memory 650 also may be used for storing temporary variables or other intermediate information during execution of instructions by processor 610. Platform 600 also comprises read only memory (ROM) and/or static storage device 620 coupled to bus 615 for storing static information and instructions for processor 610, and data storage device 625 such as a magnetic disk, optical disk and its corresponding disk drive, or a portable storage device (e.g., a universal serial bus (USB) flash drive, a Secure Digital (SD) card). Data storage device 625 is coupled to bus 615 for storing information and instructions.

Platform 600 may further be coupled to display device 670, such as a cathode ray tube (CRT) or an LCD coupled to bus 615 through bus 665 for displaying information to a computer user. In embodiments where platform 600 provides computing ability and connectivity to a created and installed display device, display device 670 may comprise any of the tileable display panels described above. Alphanumeric input device 675, including alphanumeric and other keys, may also be coupled to bus 615 through bus 665 (e.g., via infrared (IR) or radio frequency (RF) signals) for communicating information and command selections to processor 610. An additional user input device is cursor control device 680, such as a mouse, a trackball, stylus, or cursor direction keys coupled to bus 615 through bus 665 for communicating direction information and command selections to processor 610, and for controlling cursor movement on display device 670. In embodiments utilizing a touch-screen interface, it is understood that display 670, input device 675 and cursor control device 680 may all be integrated into a touch-screen unit.

Another device, which may optionally be coupled to platform 600, is a communication device 690 for accessing other nodes of a distributed system via a network. Communication device 690 may include any of a number of commercially available networking peripheral devices such as those used for coupling to an Ethernet, token ring, Internet, or wide area network. Communication device 690 may further be a null-modem connection, or any other mechanism that provides connectivity between computer system 600 and the outside world. Note that any or all of the components of this system illustrated in FIG. 6 and associated hardware may be used in various embodiments of the disclosure.

It will be appreciated by those of ordinary skill in the art that any configuration of the system illustrated in FIG. 6 may be used for various purposes according to the particular implementation. The control logic or software implementing embodiments of the disclosure can be stored in main memory 650, mass storage device 625, or other storage medium locally or remotely accessible to processor 610.

It will be apparent to those of ordinary skill in the art that any system, method, and process to capture media data as described herein can be implemented as software stored in main memory 650 or read only memory 620 and executed by processor 610. This control logic or software may also be resident on an article of manufacture comprising a computer readable medium having computer readable program code embodied therein and being readable the mass storage device 625 and for causing processor 610 to operate in accordance with the methods and teachings herein.

Embodiments of the disclosure may also be embodied in a handheld or portable device containing a subset of the computer hardware components described above. For example, the handheld device may be configured to contain only the bus 615, the processor 610, and memory 650 and/or 625. The handheld device may also be configured to include a set of buttons or input signaling components with which a user may select from a set of available options. The handheld device may also be configured to include an output apparatus such as a LCD or display element matrix for displaying information to a user of the handheld device. Conventional methods may be used to implement such a handheld device. The implementation of the disclosure for such a device would be apparent to one of ordinary skill in the art given the disclosure as provided herein.

Embodiments of the disclosure may also be embodied in a special purpose appliance including a subset of the computer hardware components described above. For example, the appliance may include processor 610, data storage device 625, bus 615, and memory 650, and only rudimentary communications mechanisms, such as a small touch-screen that permits the user to communicate in a basic manner with the device. In general, the more special-purpose the device is, the fewer of the elements need be present for the device to function.

Some portions of the detailed description above are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent series of operations leading to a desired result. The operations are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the discussion above, it is appreciated that throughout the description, discussions utilizing terms such as "capturing," "transmitting," "receiving," "parsing," "forming," "monitoring," "initiating," "performing," "adding," or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

Embodiments of the disclosure also relate to an apparatus for performing the operations herein. This apparatus may be specially constructed for the required purposes, or it may comprise a general purpose computer selectively activated or reconfigured by a computer program stored in the computer. Such a computer program may be stored in a non-transitory computer readable storage medium, such as, but not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions.

Some portions of the detailed description above are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as "capturing", "determining", "analyzing", "driving", or the like, refer to the actions and processes of a computer system, or similar electronic computing device, that manipulates and transforms data represented as physical (e.g., electronic) quantities within the computer system's registers and memories into other data similarly represented as physical quantities within the computer system memories or registers or other such information storage, transmission or display devices.

The algorithms and displays presented above are not inherently related to any particular computer or other apparatus. Various general purpose systems may be used with programs in accordance with the teachings herein, or it may prove convenient to construct a more specialized apparatus to perform the required method steps. The required structure for a variety of these systems will appear from the description below. In addition, the present disclosure is not described with reference to any particular programming language. It will be appreciated that a variety of programming languages may be used to implement the teachings of the disclosure as described herein.

Reference throughout this specification to "one embodiment" or "an embodiment" means that a particular feature, structure, or characteristic described in connection with the embodiment is included in at least one embodiment of the present disclosure. Thus, the appearances of the phrases "in one embodiment" or "in an embodiment" in various places throughout the above specification are not necessarily all referring to the same embodiment. Furthermore, the particular features, structures, or characteristics may be combined in any suitable manner in one or more embodiments.

The present description, for purpose of explanation, has been described with reference to specific embodiments. However, the illustrative discussions above are not intended to be exhaustive or to limit the disclosure to the precise forms disclosed. Many modifications and variations are possible in view of the above teachings. The embodiments were chosen and described in order to best explain the principles of the disclosure and its practical applications, to thereby enable others skilled in the art to best utilize the various embodiments with various modifications as may be suited to the particular use contemplated.

The invention claimed is:

1. A tileable display panel comprising:

a screen layer upon which a unified image is projected from a backside;

an illumination layer including a two-dimensional array of lamps to generate lamp light;

a display layer disposed between the screen layer and illumination layer, the display layer including a plurality of pixelets separated from each other by spacing regions, wherein each of the pixelets is positioned to be illuminated by a corresponding lamp from the illumination layer to project a magnified image sub-portion corresponding to one of a plurality of received subsets of pixel data onto the backside of the screen layer such that the magnified image sub-portions collectively blend together to form the unified image which covers the spacing regions on the display layer; and a controller including illumination layer control logic coupled to:

determine a brightness value for each of the received subsets of pixel data which each correspond to a different one of the magnified image sub-portions;

convert the pixel data to a higher bit depth representation based, at least in part, on the determined brightness values of the pixel data; and independently adjust an illumination setting for each of the magnified image sub-portions to reduce or increase an illumination output of a corresponding lamp in the illumination layer based, at least in part, on the brightness value of the corresponding one of the received subsets of pixel data.

2. The tileable display panel of claim 1, wherein adjusting an illumination setting to reduce or increase an illumination output of a lamp in the illumination layer comprises:

reducing the illumination output of the lamp in response to determining an average luminance of the brightness values of the corresponding subset of the pixel data is less than a threshold value.

3. The tileable display panel of claim 1, wherein adjusting an illumination setting to reduce or increase an illumination output of a lamp in the illumination layer comprises:

increasing the illumination output of the lamp in response to determining an average luminance of the brightness values of the corresponding subset of the pixel data is greater than a threshold value.

4. The tileable display panel of claim 1, wherein adjusting an illumination setting to reduce or increase an illumination output of a lamp in the illumination layer comprises:

reducing the illumination output of the lamp in response to determining a luminance of a majority of pixels of the corresponding subset of the pixel data have a luminance value less than a threshold value.

5. The tileable display panel of claim 1, wherein adjusting an illumination setting to reduce or increase an illumination output of a lamp in the illumination layer comprises:

increasing the illumination output of the lamp in response to determining a luminance of a majority of pixels of the corresponding subset of the pixel data have a luminance value greater than a threshold value.

6. The tileable display panel of claim 1, further comprising:

an ambient light sensor; wherein adjusting an illumination setting to reduce or increase an illumination output of a lamp in the illumination layer includes adjusting the illumination output of the array of lamps based, at least in part, on a measured ambient light.

7. The tileable display panel of claim 1, wherein each lamp of the illumination layer is centered under its corresponding pixelet.

8. The tileable display panel of claim 1, wherein at least a portion of the spacing regions separating the plurality of pixelets of the display layer includes a backplane region that includes pixel logic for driving pixels of the pixelets.

9. The tileable display panel of claim 8, wherein the pixel logic includes memory-in-pixel.

10. The tileable display panel of claim 1, wherein additional optics are disposed over each lamp of the illumination layer to define a limited angular spread for the lamp light.

11. The tileable display panel of claim 1, wherein additional optics are disposed over the lamps of the illumination layer to increase brightness uniformity of the display light propagating toward the pixelets.

12. The tileable display panel of claim 1, wherein each of the plurality of pixelets of the display layer comprises an array of transmissive display pixels.

13. A method comprising:

receiving a plurality of subsets of pixel data for a tileable display panel to display a unified image, wherein the tileable display panel comprises:

a screen layer upon which the unified image is projected from a backside;

an illumination layer including a two-dimensional array of lamps to generate lamp light; and a display layer disposed between the screen layer and illumination layer, the display layer including a plurality of pixelets separated from each other by spacing regions, wherein each of the pixelets is positioned to be illuminated by a corresponding lamp from the illumination layer and to project a magnified image sub-portion corresponding to one of the received subsets of pixel data onto the backside of the screen layer such that the magnified image sub-portions collectively blend together to form the unified image which covers the spacing regions on the display layer;

for each of the received subsets of the pixel data, which each correspond to a different one of the magnified image sub-portions:

determining a brightness value for the respective subset of pixel data;

converting the pixel data to a higher bit depth representation based, at least in part, on the determined brightness values of the pixel data;

independently adjusting an illumination setting for each of the magnified image sub-portions to reduce or increase an illumination output of a corresponding lamp in the illumination layer based, at least in part, on the brightness value of the corresponding one of the received subsets of the pixel data; and illuminating the lamps of the illumination layer to project the magnified image sub-portions to form the unified image.

14. The method of claim 13, wherein adjusting an illumination setting of a lamp in the illumination layer comprises:

reducing the illumination output of the lamp in response to determining an average luminance of the brightness values of the corresponding subset of the pixel data is less than a threshold value.

15. The method of claim 13, wherein adjusting an illumination setting of a lamp in the illumination layer comprises:

increasing the illumination output of the lamp in response to determining an average luminance of the brightness values of the corresponding subset of the pixel data is greater than a threshold value.

16. The method of claim 13, wherein adjusting an illumination setting of a lamp in the illumination layer comprises:

reducing the illumination output of the lamp in response to determining a luminance of a majority of pixels of the corresponding subset of the pixel data have a luminance value less than a threshold value.

17. The method of claim 13, wherein adjusting an illumination setting of a lamp in the illumination layer comprises:

increasing the illumination output of the lamp in response to determining a luminance of a majority of pixels of the corresponding subset of the pixel data have a luminance value greater than a threshold value.

18. The method of claim 13, wherein adjusting an illumination setting of a lamp in the illumination layer comprises:

reducing the illumination output of the lamp in response to determining a maximum luminance value for the pixels of the corresponding subset of the pixel data is less than a threshold value.

19. The method of claim 13, wherein adjusting an illumination setting of a lamp in the illumination layer is further based, at least in part, on a content of the sub-image portion to be projected by the respective lamp.

20. The method of claim 13, wherein adjusting an illumination setting to reduce or increase an illumination output of a lamp in the illumination layer comprises:

adjusting the illumination output of array of lamps based, at least in part, on a measured ambient light.

21. The method of claim 13, wherein converting the pixel data to a higher bit depth representation comprises:

applying a tone mapping function to adjust a dynamic range of the pixel data.

22. The method of claim 13, wherein at least two pixelets of the display layer of the tileable display panel are spaced such that their corresponding magnified image sub-portions at least partially overlap at an overlapping region, and the method further comprises:

adjusting the converted pixel data to reduce a transition brightness for the overlapping region to match a brightness of non-overlapping regions of the at least two pixelets.

23. The method of claim 13, wherein each of the plurality of pixelets of the display layer of the tileable display panel comprises an array of transmissive display pixels.

24. A non-transitory computer readable storage medium including instructions that, when executed by a processor, cause the processor to perform a method comprising:

receiving a plurality of subsets of pixel data for a tileable display panel to display a unified image, wherein the tileable display panel comprises:

a screen layer upon which the unified image is projected from a backside;

an illumination layer including a two-dimensional array of lamps to generate lamp light; and a display layer disposed between the screen layer and illumination layer, the display layer including a plurality of pixelets separated from each other by spacing regions, wherein each of the pixelets is positioned to be illuminated by a corresponding lamp from the illumination layer and to project a magnified image sub-portions corresponding to one of the received subset of pixel data onto the backside of the screen layer such that the magnified image sub-portions collectively blend together to form the unified image which covers the spacing regions on the display layer;

for each of the received subsets of the pixel data, which each correspond to a different one of the magnified image sub-portions:

determining a brightness value for the respective subset of pixel data;

converting the pixel data to a higher bit depth representation based, at least in part, on the determined brightness values of the pixel data; and independently adjusting an illumination setting to reduce or increase an illumination output of a lamp in the illumination layer based, at least in part, on the brightness value of the corresponding subset of the pixel data; and illuminating the lamps of the illumination layer to project the magnified image sub-portions to form the unified image.

25. The non-transitory computer readable storage medium of claim 24, wherein converting the pixel data to a higher bit depth representation comprises:

applying a tone mapping function to adjust a dynamic range of the pixel data.

26. The non-transitory computer readable storage medium of claim 24, wherein at least two pixelets are spaced such that their corresponding magnified image sub-portions at least partially overlap at an overlapping region, and the method further comprises:

adjusting the converted pixel data to reduce a transition brightness for the overlapping region to match a brightness of non-overlapping regions of the at least two pixelets.

27. The non-transitory computer readable storage medium of claim 24, wherein each of the plurality of pixelets of the display layer of the tileable display panel comprises an array of transmissive display pixels.

* * * * *